United States Patent [19]

Hatta

[11] Patent Number: 4,696,642

[45] Date of Patent: Sep. 29, 1987

[54] APPARATUS FOR CONTINUOUSLY HEATING AN ELONGATED TEXTILE ARTICLE

[75] Inventor: Keizo Hatta, Uozu, Japan

[73] Assignee: Yoshida Kogyo K. K., Tokyo, Japan

[21] Appl. No.: 857,963

[22] Filed: May 1, 1986

[30] Foreign Application Priority Data

May 15, 1985 [JP] Japan ..... 60-71889[U]

[51] Int. Cl.[4] ..... F27B 9/28

[52] U.S. Cl. ..... 432/59; 432/8; 432/242

[58] Field of Search ..... 432/59, 8, 242; 34/242

[56] References Cited

U.S. PATENT DOCUMENTS

| | | | |
|---|---|---|---|
| 3,186,694 | 6/1965 | Beggs | 432/8 |
| 3,306,594 | 2/1967 | Bauer | 432/242 |
| 3,561,080 | 2/1971 | Weinstein | 432/242 |
| 4,217,090 | 8/1980 | Whike et al. | 432/8 |
| 4,484,889 | 11/1984 | Manchal et al. | 432/59 |
| 4,493,640 | 1/1985 | Hanson | 432/59 |
| 4,529,379 | 7/1985 | DiCastri | 432/59 |
| 4,575,952 | 3/1986 | Bodenan et al. | 34/242 |
| 4,590,916 | 5/1986 | Konig | 432/242 |
| 4,610,627 | 9/1986 | Wise | 432/8 |

FOREIGN PATENT DOCUMENTS 47-21276 6/1972 Japan .

*Primary Examiner*—Henry C. Yuen

*Attorney, Agent, or Firm*—Hill, Van Santen, Steadman & Simpson

[57] ABSTRACT

An apparatus for continuously heating an elongated textile article comprises a box mounted within a heating chamber at its inlet and/or outlet so as to cover the same, and a pipe connected at one end to the box and leading to a point upstream of a heat source of a heated-air circulating system. The pipe draws the outside air entering into the box also the heated air leaking out of the heating chamber, and then discharges or releases the mixture upstream of the heat source. The thus discharged mixture of the outside air and the heated air is additionally heated as a recirculating heated air.

1 Claim, 3 Drawing Figures

APPARATUS FOR CONTINUOUSLY HEATING AN ELONGATED TEXTILE ARTICLE

BACKGROUND OF THE INVENTION

1. Field of the Invention

The present invention relates to an apparatus for continuously heating an elongate textile article, such as yarn, tape or cloth, to thereby continuously dry or heat-treat the same.

2. Description of the Prior Art

Conventionally, in order for not impairing heating effect in such apparatus, attempts have been made to prevent cold outside air from entering into the heating chamber via its inlet or outlet for the elongate textile article to be heated. For example, Japanese Patent Post-Examination Publication (Tokkosho) No. 47-21276 discloses, as reillustrated in FIG. 3 of the accompanying drawings, a heating apparatus having a small-pressure box A which is mounted within the heating chamber at the inlet or outlet and into which a portion of superheated vapor for heat treatment is to be forced to equalize the air pressure of the small-pressure box to the pressure of air outside the heating chamber. However, a primary problem of such prior art is that a stream of heated air forced into the small-pressure box would flow out of the heating chamber via the inlet or outlet, thus causing a loss of heat energy. Another problem of the prior art apparatus is that, when an elongated textile article containing oil is heat-treated, smoke from the oil would develop and would be mixed in a circulating stream of heated air. The smoke from the oil together with the stream of heated air would then flow out of the heating chamber via the small-pressure box, thus contaminating the environment around the apparatus.

SUMMARY OF THE INVENTION

It is therefore an object of the present invention to provide an apparatus for continuously heating an elongated textile article, in which apparatus non-uniform distribution in temperature around the outlet or inlet due to the entering of cold outside air can be prevented and in which outflow of the heated air from the heating chamber can be prevented.

According to the present invention, an apparatus for continuously heating an elongated textile article comprises a box mounted within a heating chamber at its inlet and/or outlet so as to cover the same, and a pipe connected at one end to the box and leading to a point upstream of a heat source of a heated-air circulating system. By the sucking action of the circulating system, the pipe draws some outside air into the box and heated air flows out of the heating chamber into the box, and then discharges or releases the mixed air upstream of the heat source. The thus discharged mixture of the outside air and the heated air is additionally heated as a recirculating heated air.

Many other advantages, features and additional objects of the present invention will become manifest to those versed in the art upon making reference to the detailed description and the accompanying drawings in which two preferred embodiments incorporating the principles of the present invention are shown by way of illustrative example.

DETAILED DESCRIPTION

Figure 1:
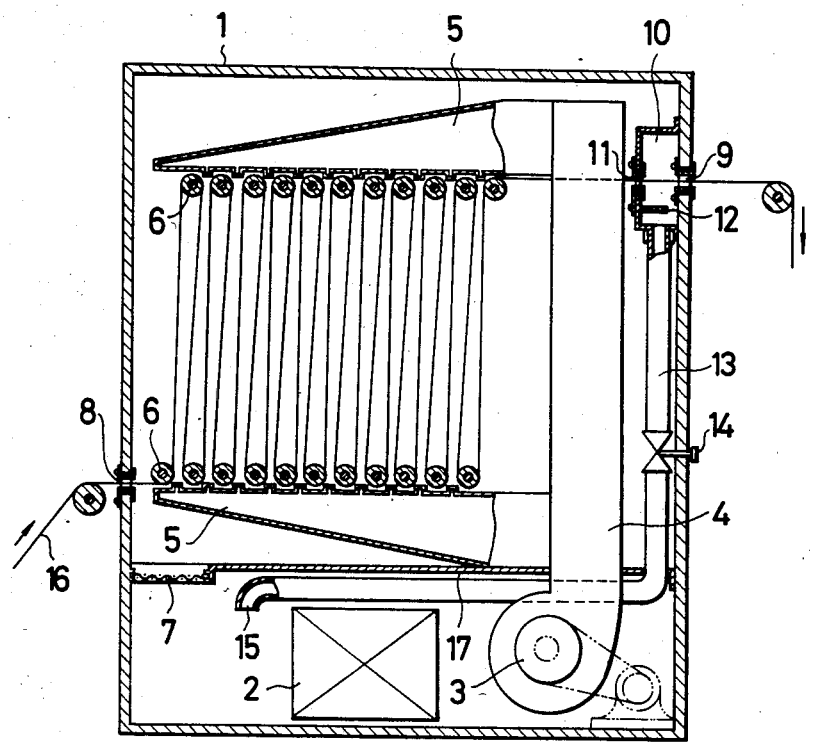
FIG. 1 is a cross-sectional view of a heating apparatus embodying the present invention.

FIG. 1 shows an apparatus for continuously heating an elongate textile article such as a continuous or substantially endless tape 16 for slide fasteners (hereinafter referred to as "fastener tape") to thereby dry or heat-treat it. The apparatus of FIG. 1 is particularly useful in drying the textile article, the article having been merely washed with water or having been dyed.

The apparatus has a heating chamber 1 defined by a surrounding wall of heat-insulating material and having an inlet 8 and an outlet 9. The inlet 8 and outlet 9 are disposed at opposite sides of the chamber 1 and each of them is in the form of a slit which is adjustable in height so as to minimize not only the outflow of heated air in the heating chamber 1 but the entering of outside air. The heating chamber 1 is divided by a horizontal partition 17 into a pair of upper and lower sections.

A pair of upper and lower rows of rollers 6, 6 are horizontally supported within the upper section of the heating chamber 1 for supporting the fastener tape 16 therearound in a zigzag form. Within the lower section of the heating chamber 1, a heater 2 for heating air and a fan 3 for circulating the heated air in the heating chamber 1 are disposed. The fan 3 communicates, via a duct 4, with a pair of upper and lower nozzles 5, 5 disposed adjacent to the upper and lower rows of rollers 6, 6, respectively, for emitting the heated air over the fastener tape 16 while the latter is being conveyed on and around the upper and lower rows of rollers 6, 6. By the sucking action of the fan 3, the emitted heated air is drawn into the lower section of the heating chamber 1 through a filtered suction opening 7 in a corner of the horizontal partition 17 and is then returned to the fan 3 via the heater 2 where the thus drawn heated air is heated again to be transmitted to the upper and lower nozzles 5, 5 by the fan 3. Thus the heated air circulates in the heating chamber 1.

Most importantly, the apparatus also includes a box 10 mounted on the interior side of the heating chamber 1 so as to cover the outlet 9, and a pipe 13 connected at one end to the box 10 and leading to a point upstream of the heater 2. The box 10 has a slit 11 which is horizontally aligned with the outlet 9; after having been heat-treated, the fastener tape 16 is introduced into the box 10 from the slit 11 and is then discharged out of the box through the outlet 9. The sucking action of the fan 3 reaches to the interior of the box 10 via the pipe 13. That is, both the heated air leaking into the box 10 via the slit 11 and the outside air entering into the box 10 via the outlet 9 are drawn into the lower section of the heating chamber 1 through the pipe 13 and are then reheated, together with the heated air circulated via the filtered opening 7, by the heater 2. Subsequently, such reheated mixture of the heated air or outside air is sent out to the upper section of the heating chamber 1 via the upper and lower nozzles 5, 5 by the fan 3.

The pipe 13 is provided with a valve 14 for varying the amount of air flow through pipe 13 to adjust the negative pressure in the box 10. The box 10 has therein a horizontal eave-like partition 12 disposed between the upper mouth of the pipe 13 and the slit 11 and is coextensive with the width of the box 10, the upper mouth of the pipe 13 being disposed in the center of the bottom of the box 10. The eave-like partition 12 projects from the inner (leftside) wall of the box 10 toward and terminates short of the rightside wall of the heating chamber 1, With the eave-like partition 12, the sucking force derived from the fan 3 and hence the pipe 13 can reach to the slit 11 and the outlet 9 uniformly throughout the entire width thereof, though the upper mouth of the pipe 13 is disposed only centrally in the bottom of the box 10.

Thus, high-temperature heated air in the heating chamber 1 is prevented from leaking out of the heating chamber 1 via the outlet 9, and hence a loss of heat energy is avoided. Further, since the cold outside air entering into the box 10, together with the heated air leaked into the box 10, is released in front of the heater 2, from the lower mouth 15 of the pipe 13 and is then heated for circulation through the upper and lower nozzles 5, 5, uniform distribution in temperature of heated air in the entire heating chamber 1 is achieved, thus guaranteeing uniform heat-treating of the fastener tape 16.

In the foregoing embodiment, the box 10 is mounted at the outlet 8 of the heating chamber 1. However, the box 10 may be mounted at the inlet 8 of the heating chamber 1 with the same result as the foregoing embodiment. For another alternative, a pair of boxes 10, 10 may be mounted one at each of the inlet 8 and outlet 9 of the heating chamber 1, producing a better result.

Figure 2:
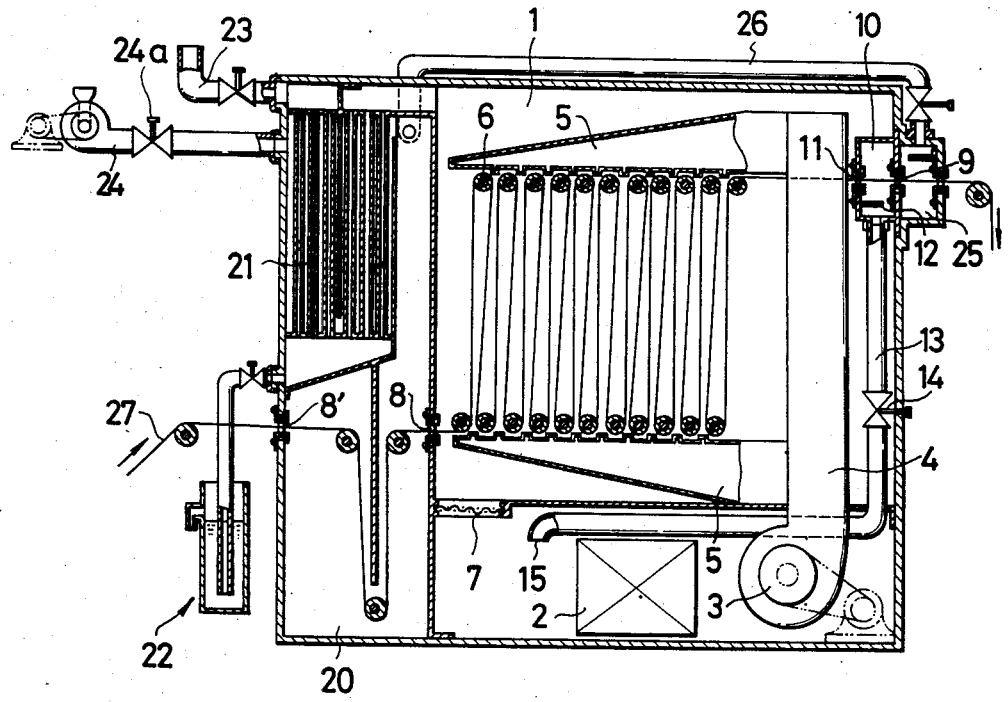
FIG. 2 is a cross-sectional view of a modified heating apparatus having a discharge system for smoke from the oil.
Figure 3:
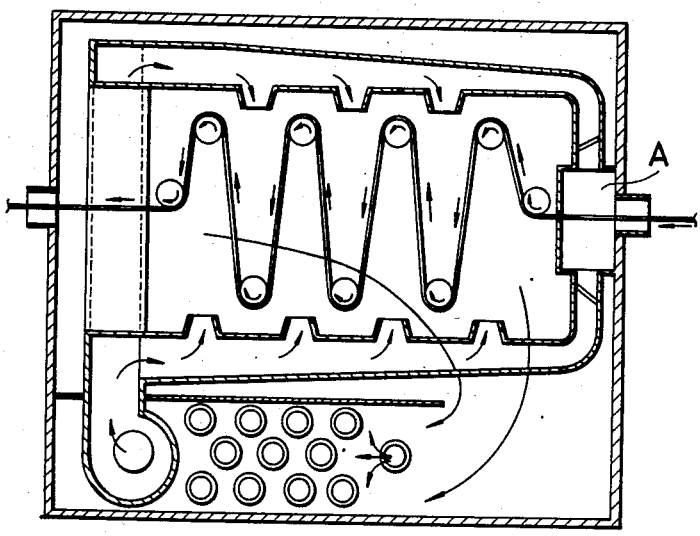
FIG. 3 PRIOR ART
FIG. 3 is a cross-sectional view of a prior art heating apparatus.

FIG. 2 shows a modified embodiment in which the present invention is applied to an apparatus for heat-treating an elongated textile article treated with oil in a preceding manufacturing step, such as twisting, weaving or knitting. The textile article to be heat-treated in the modified embodiment comprises a slide fastener tape. Conventionally, in heat-treating such elongated textile article containing oil, smoke is produced from the oil which partially stays in the chamber to stain the article and which partially leaks out of the heating chamber to pollute the environment. Such prior problems can be prevented by the apparatus of FIG. 2 in which a portion of heated air is discharged out of the heating chamber 1, while a corresponding amount of fresh outside air is taken into the heating chamber 1.

The apparatus of FIG. 2 has a pre-heating chamber 20 adjoining the heating chamber 1 at an inlet side thereof and has an auxiliary inlet 8' through which the textile article is to be introduced into the pre-heating chamber 20. The pre-heating chamber 20 has in its upper portion a heat exchanger 21 through which a portion of heated air in the heating chamber 1 is to be discharged out of the apparatus via an exhaust pipe 23. A pipe 24 is connected to the upper portion of the pre-heating chamber 20 for introducing an amount of fresh outside air into the heat exchanger 21 which amount corresponds to the amount of the heated air discharged. The fresh outside air is heated by the exhaust heat in the heat exchanger 21 and is then sent out to the pre-heating chamber 20 for pre-heating the fastener tape 27. At that time, oil smoke contained in the exhaust air is cooled by the cold outside air so that a tar substance (of oil) accumulates in the heat exchanger 21 and sticks thereto. In order to avoid such sticking of the tar substance and to clean the heat exchanger, a valve **24*a* of the suction pipe 24 is selectively closed to stop introduction of fresh cooler outside air so that the accumulated tar substance becomes heated and liquid and then drains into an oil collector 22 disposed below the heat exchanger 21**.

Further, an additional box 25 is mounted on the exterior side of the outlet 9 of the heating chamber 1 for receiving the thus heated and hence hot outside air from the pre-heating chamber 20 via a connecting pipe 26 to prevent cold outside air from entering into the additional box 25.

On the interior side of the outlet 9 of the heating chamber 1, the box 10 and the pipe 13 (both described above in connection with FIG. 1) are disposed; the heated air leaked from the heating chamber 1, together with the air cooled by the entering cold outside air, is drawn to the lower section of the heating chamber 1 where such mixture of the heated air and the cooled air is heated again by the heater 2 and is then sent out to the upper section of the heating chamber 1 by the fan 3. In an alternative form, the box 10 and the pipe 13 may be omitted from the apparatus of FIG. 2.

According to the present invention, since the heated air leaked into the box 10 is drawn into the pipe 13 and then is discharged or released therefrom upstream of the heater 2, it is possible to use this heated air for recirculation in the heating chamber 1 without discharging air out of the heating apparatus, thus preventing a loss of heat energy. Further, since the cold outside air entering into the box 10 is drawn into the pipe 13 is then discharged or released therefrom upstream of the heater 2 without exerting an influence on a stream of heated air to be applied over the textile article 16, it is possible to maintain uniform temperature distribution in the heating chamber 1, thus causing uniform heat-treating of the elongate textile article.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for continuously heating an elongate textile article, comprising: a heating chamber divided into a pair of upper and lower sections, said upper chamber section having an inlet at one side for continuously introducing the textile article into said heating chamber, and an outlet at the other side for continuously discharging the textile article out of said heating chamber; a heater mounted in said lower chamber section for heating air therein; a heated-air circulating system for continuously transmitting the heated air from said lower chamber section to said upper chamber section; a box mounted on said heating chamber at least at one of said inlet and outlet so as to cover the same and having a slit for passage of the textile article, said box having therein an eave-like baffle partition disposed between said slit and said one end of said pipe, said eave-like partition being coextensive with the width of said box and projecting from an inner wall of said box toward and terminating short of an outer wall of said heating chamber; and a pipe opening at one end into said box and at the other end toward an upstream side of said heater, said one end of said pipe being disposed centrally in a bottom of said box so as to lie under said eave-like partition.

* * * * *